US010724226B2

(12) United States Patent
Van Parys

(10) Patent No.: US 10,724,226 B2
(45) Date of Patent: Jul. 28, 2020

(54) MORTISE LOCK FOR A WINDOW OR DOOR

(71) Applicant: Emmanuel Van Parys, Wortegem-Petegem (BE)

(72) Inventor: Emmanuel Van Parys, Wortegem-Petegem (BE)

( * ) Notice: Subject to any disclaimer, the term of this patent is extended or adjusted under 35 U.S.C. 154(b) by 346 days.

(21) Appl. No.: 15/432,613

(22) Filed: Feb. 14, 2017

(65) Prior Publication Data

US 2017/0234043 A1 Aug. 17, 2017

(30) Foreign Application Priority Data

Feb. 15, 2016 (BE) ..... 2016/5109

(51) Int. Cl.

| | |
|---|---|
| ***E04B 1/00*** | (2006.01) |
| ***E05B 63/08*** | (2006.01) |
| ***E05B 65/06*** | (2006.01) |
| ***E05C 9/04*** | (2006.01) |
| ***E04B 1/78*** | (2006.01) |
| ***E04C 5/16*** | (2006.01) |
| *E04C 5/07* | (2006.01) |

(52) U.S. Cl.

CPC ..... *E04B 1/0038* (2013.01); *E04B 1/78* (2013.01); *E04C 5/16* (2013.01); *E05B 63/08* (2013.01); *E05B 65/06* (2013.01); *E05C 9/041* (2013.01); *E04C 5/07* (2013.01)

(58) Field of Classification Search

CPC ..... E04B 1/0038; E04B 1/78; E04B 63/08; E04B 65/06; E04B 1/003; E04B 65/08; E04B 1/80; E04C 5/16; E04C 5/07; E04C 5/161; E04C 5/162; E05C 9/041

USPC ..... 292/336.3

See application file for complete search history.

(56) References Cited

U.S. PATENT DOCUMENTS

| | | | | |
|---|---|---|---|---|
| 4,848,811 A * | 7/1989 | Laufenburg | ..... | E05C 9/021 292/142 |
| 5,509,703 A * | 4/1996 | Lau | ..... | E05C 3/042 292/1 |
| 5,620,216 A * | 4/1997 | Fuller | ..... | E05B 55/00 292/142 |
| 6,035,674 A * | 3/2000 | Nickel | ..... | E05C 9/06 292/142 |

(Continued)

FOREIGN PATENT DOCUMENTS

| | | |
|---|---|---|
| BE | 1018951 | 11/2011 |
| CH | 173141 | 11/1934 |

(Continued)

*Primary Examiner* — Nathan Cumar

(74) *Attorney, Agent, or Firm* — Young & Thompson

(57) ABSTRACT

Mortise lock with an operating mechanism with a pinion that is turnable around a geometric axis and a rack engaging therewith that is movable along a direction perpendicular to the aforementioned geometric axis, whereby the pinion is provided with a double toothing with two sets of teeth that are separated by a geometric dividing plane that extends perpendicularly to the axial direction of the pinion, wherein the teeth of each set of teeth of the pinion form an oblique toothing, whereby the faces of these teeth are oblique with respect to the axial direction and these faces include an angle to one another that is such that the width of the teeth of each of the two sets of teeth either decreases or increases in the direction of the dividing plane.

20 Claims, 11 Drawing Sheets

(56) References Cited

U.S. PATENT DOCUMENTS

| | | | | |
|---|---|---|---|---|
| 6,871,884 | B2 * | 3/2005 | Hoffmann | E05C 9/041 292/112 |
| 6,994,383 | B2 * | 2/2006 | Morris | E05B 13/004 292/112 |
| 8,398,126 | B2 * | 3/2013 | Nakanishi | E05B 63/185 292/1.5 |

FOREIGN PATENT DOCUMENTS

| | | |
|---|---|---|
| DE | 202004017882 | 2/2005 |
| DE | 102012101117 | 8/2013 |
| DE | 102013105303 | 8/2014 |
| WO | 2015198171 | 12/2015 |

* cited by examiner

MORTISE LOCK FOR A WINDOW OR DOOR

BACKGROUND OF THE INVENTION

The present invention relates to a mortise lock for a window, door or similar.

More specifically the invention is intended for a mortise lock with a housing that is provided with an operating mechanism with a pinion that is turnably mounted in the housing and a rack engaging therewith that is movably affixed in the housing, whereby a turning movement of the pinion, by means of a handle or a key, must be converted into a sliding movement of a rack, which in turn ensures the opening and closing of the lock.

Such a mortise lock is generally built into the space between the fixed frame and the movable leaf of the window, the door or similar, whereby the available space is limited so that in such a case the diameter of the pinion must necessarily be small, for example of the order of magnitude of a maximum of 15 millimetres or even less than 10 millimetres, for the transmission of nonetheless relatively large forces.

Such a mortise lock is known in DE 10.2013.105.303 with an operating mechanism with a pinion and a rack engaging therewith, each with two toothings that are separated from one another by a geometric dividing plane that extends perpendicularly to the axial direction of the pinion and which are both constructed as a straight toothing, in other words a toothing whose faces, viewed in the longitudinal direction, extend parallel to one another and are perpendicular to the aforementioned dividing plane. The teeth of both toothings are in line with one another in this case.

Such a mortise lock is known in BE 1.018.951, as well as an embodiment in which the teeth of the two toothings are offset with respect to one another by one toothing being turned by a half pitch of the teeth with respect to the other toothing, such that a smoother transmission is realised, because in this way when driving the pinion twice the number of transitions is realised between the end of the contact between two teeth of the pinion and the rack, and the start of the contact between the next two teeth of the pinion and the rack.

In both cases a disadvantage is that the transition contact zone is generally small and critical and is usually situated at the level of the top of the teeth where there is a real risk of turning over and a juddery transmission, whereby this risk is all the greater as the diameter of the pinion becomes smaller.

An embodiment is also known in DE 10.2013.105.303 whereby the two toothings are constructed as an oblique toothing with teeth whose faces are parallel but which make an angle to the axial direction, whereby the teeth are oriented such that both toothings together form an arrow toothing.

The arrow toothing ensures that the axial forces cancel out one another, but has just as much the same disadvantage: a real risk of turning over when the diameters of the pinion are small.

Such arrow toothing also has the disadvantage that a complex mould is required to manufacture the pinion out of plastic or metal with a conventional injection moulding technique, and to be able to remove the injected pinion from the mould after injection moulding, which results in a high production cost.

SUMMARY OF THE INVENTION

The purpose of the present invention is to provide a solution to one or more of the aforementioned and other disadvantages.

To this end the invention concerns a mortise lock with a housing that is provided with an operating mechanism with a pinion that is turnable around a geometric axis that is mounted in the housing and a rack engaging therewith that is movably affixed in the housing along a direction perpendicular to the aforementioned geometric axis, whereby the pinion is provided with two toothings that are separated by a geometric dividing plane that extends perpendicularly to the axial direction of the pinion, whereby the teeth of the toothings viewed in their longitudinal direction extend axially, transverse to this dividing plane, from a broad base to a narrower top and whereby the toothings can engage with two corresponding toothings on the rack, with the characteristic that the toothings of the pinion are oblique toothings with faces of the teeth that are oblique with respect to the axial direction and these faces include an angle to one another that is such that the width of the teeth of each of the two toothings either decreases or increases in the direction of the dividing plane.

In this way more robust and thus stronger teeth are obtained than with the known mortise locks with an operating mechanism with a pinion of a similar diameter.

Moreover, the axial transmission forces that occur between the teeth of the pinion and the teeth of the rack during the use of the lock are largely cancelled out.

Preferably the teeth of the pinion, viewed in their longitudinal direction, have a tapered form with a plane of symmetry through the geometric axis of the pinion and the teeth of the rack have a complementary tapered form with a plane of symmetry parallel to this geometric axis of the pinion.

This provides even stronger and more robust teeth.

When moreover the teeth of the toothings of the pinion become wider in the axial direction towards the dividing plane, the advantage is obtained that for the injection moulding of such pinions, a simple mould can be used with two mould halves, each for one of the two toothings of the pinion, which can simply be moved apart in the axial direction for the removal of a moulded pinion from the mould.

In one embodiment, teeth of the two toothings of the pinion, and respectively of the two toothings of the rack, are aligned with respect to one another in the axial direction on either side of the dividing plane.

In this way a rhombic toothing is obtained for the pinion with robust rhombic teeth, which as it were form a double arrow toothing with a first arrow toothing that is formed by the faces on one side of the teeth and a second arrow toothing that is formed by the faces on the other side of the teeth, whereby the direction of rotation in which the point of the two arrow toothings is oriented in the opposite direction for both arrow toothings.

In this way a symmetrical load of the pinions is obtained in the one direction of rotation with respect to the other direction of rotation of the pinion.

According to a preferred embodiment, the teeth of the two toothings of the pinion, respectively the two toothings of the rack, are arranged offset with respect to one another on either side of the dividing plane.

Not only are the advantages listed above thus obtained, but the advantage of a smooth drive is also obtained because there are twice as many contact transitions between the teeth of the pinion and the teeth of the rack at the time that the contact is interrupted and resumed by two successive teeth of the pinion and the rack.

Due to the offset arrangement of the teeth, the additional advantage is obtained that upon the aforementioned contact transitions, the contact zone arises over a greater length of the teeth and at half the height of the faces rather than at the top of the teeth, such that the risk of turning over is ruled out.

According to a specific embodiment, the teeth of the pinion have a height that is measured in the radial direction from the foot to the top of the teeth that increases towards the dividing plane, viewed in the longitudinal direction of the teeth, and the teeth of the rack have a height measured from the top surface of the rack in a direction perpendicular to this top surface, which, viewed in the longitudinal direction of the teeth, decreases accordingly towards the dividing plane.

By taking advantage of the decrease in the height of the teeth in the longitudinal direction of the teeth, the distribution of forces and transmission of forces between the teeth that are in contact with one another can be further optimised.

The aforementioned advantages become particularly apparent with a small diameter of the pinion, which for a mortise lock is preferably chosen to be as small as possible and preferably is smaller than 15 millimetres, and even more preferably smaller than 10 millimetres.

More specifically, a mortise lock is known in the aforementioned DE 10.2013.105.303 that is intended to be built in between the fixed frame and a hinged leaf of a window that is equipped with locking slats that are movably affixed along the outer periphery of the leaf and which carry locking pins that can be moved in or out of corresponding locking pieces on the fixed frame due to the movement of the locking slats in order to be able to open and close the window by turning an operating handle that drives the pinion of the aforementioned operating mechanism, whereby the pinion in turn makes the rack of the operating mechanism move, the movement of which is transferred to an operating slat that is movably affixed with the U-shaped central part over the housing of the mortise lock and which is provided with arms that are provided at their free ends with a sideways protruding lip with which the operating slat is coupled or can be coupled to the aforementioned locking slats.

In this case the operating slat is made of one part as an injection moulded part with a rigid connection between the lips and the arms of the bridge-like part of the operating slat.

When opening and closing the window, opposing tensile forces and compressive forces are exerted on the operating slat via the lips that, with a rigid connection between the lips and the central U-shaped part, ensure bending moments that can cause breakages at the level of this connection.

According to a specific aspect of the invention, it has the further objective to provide at least a partial solution to this disadvantage, in this case by at least one lip being freely hingeably connected, by means of a hinge pin, to the aforementioned end of an arm concerned of the U-shaped part, whereby the hinge pin is oriented transversely to a median plane of this U-shaped part.

As a result of this hingeable connection, no undesired bending moments can occur at the location of the connection between the lip and the central U-shaped part of the operating slat that could lead to breakages.

It is clear that this aspect of the invention can also be applied to a mortise lock without an operating mechanism according to the invention.

It is also clear that an operating mechanism with a pinion and rack according to the invention can also be applied to a mortise lock without an operating slat for operating locking slats, for example in the case of a lock of a door for the operation of the latch and/or dead bolt.

BRIEF DESCRIPTION OF THE DRAWINGS

With the intention of better showing the characteristics of the invention, a preferred embodiment of a mortise lock according to the invention is described hereinafter, by way of an example without any limiting nature, with reference to the accompanying drawings, wherein.

DETAILED DESCRIPTION OF THE PREFERRED EMBODIMENTS

Figure 1:
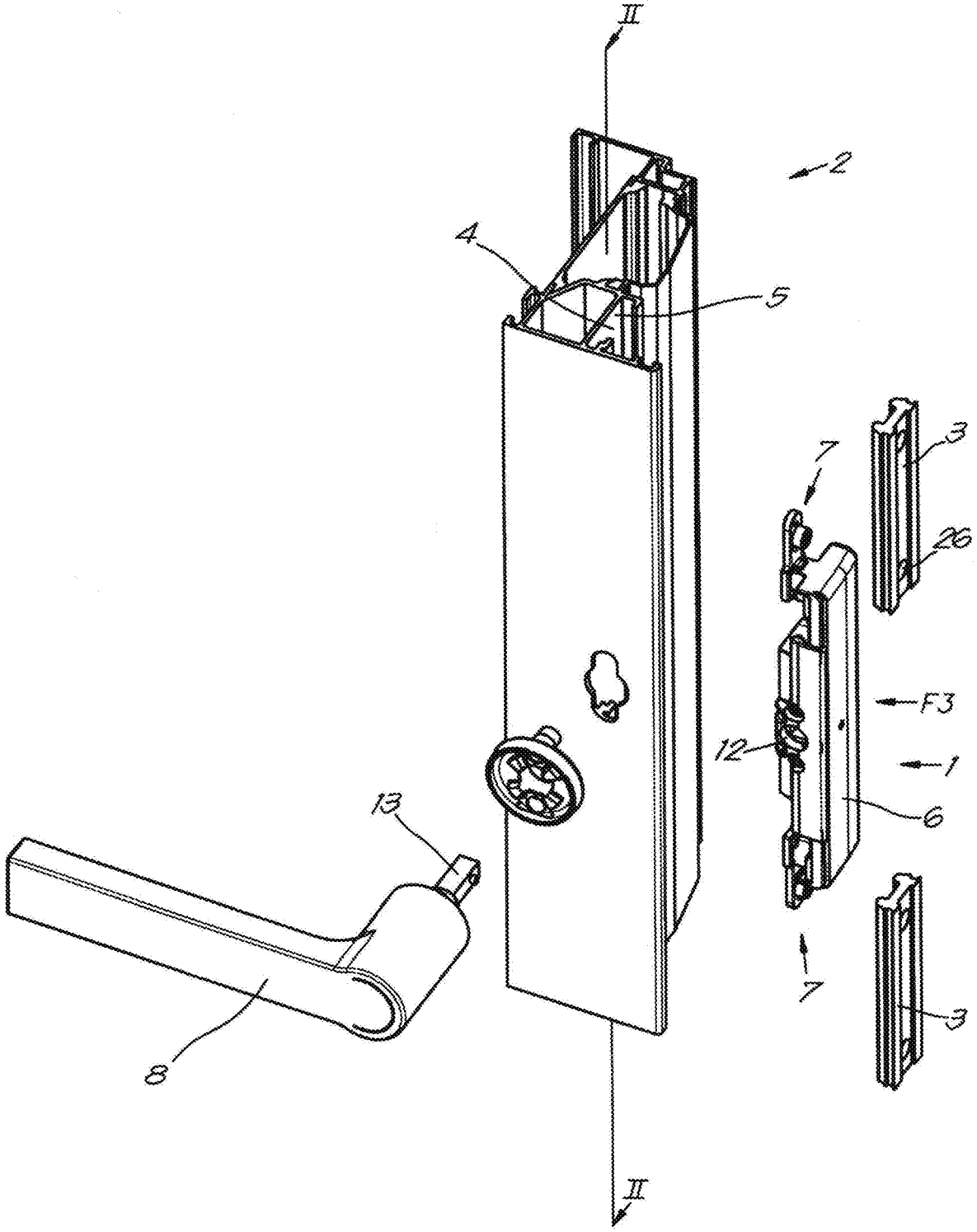
FIG. 1 schematically shows an exploded view in perspective of a leaf of a window, whereby the leaf is equipped with a mortise lock according to the invention.
Figure 2:
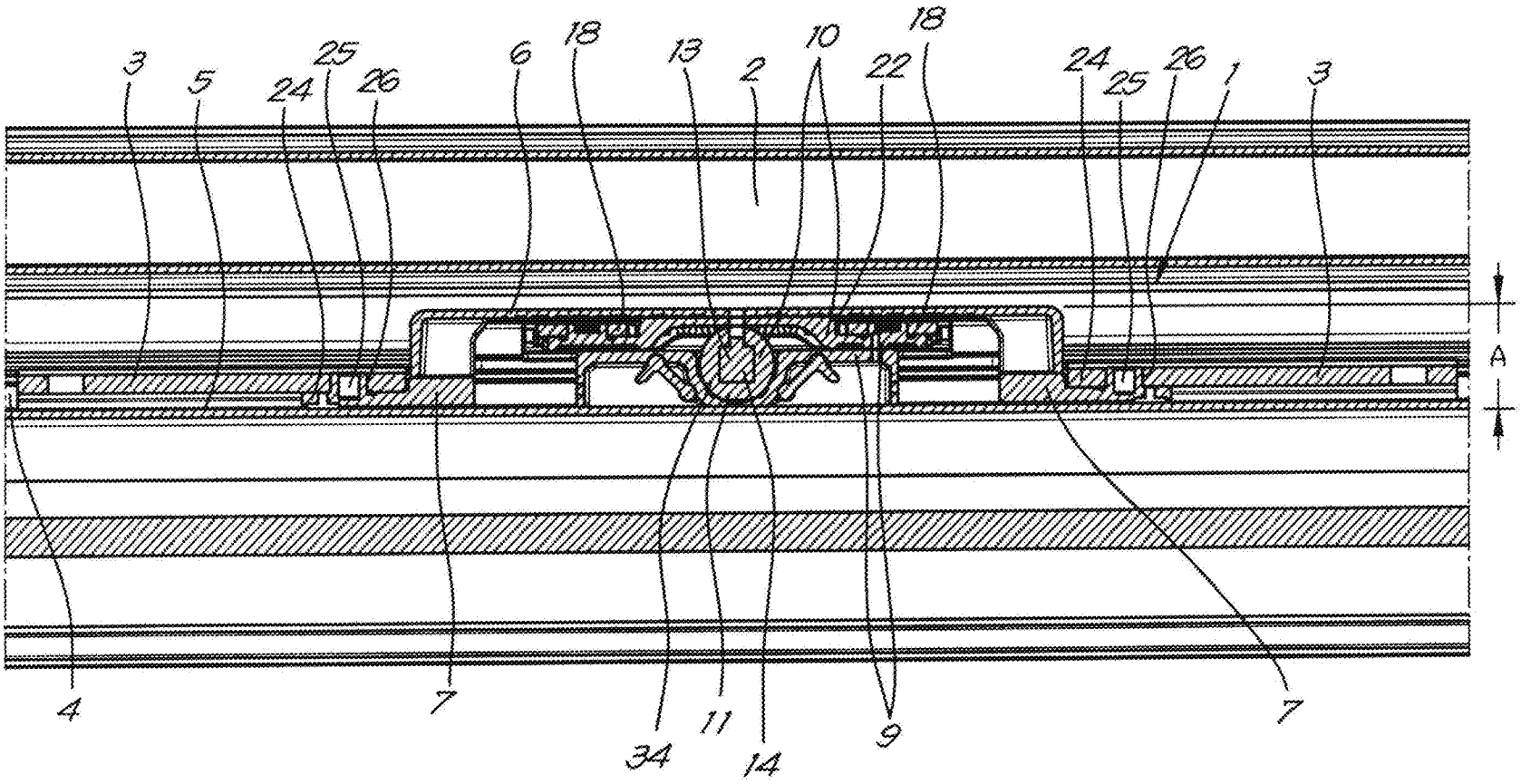
FIG. 2 shows a cross-section according to line II-II of FIG. 1, but with the mortise lock mounted.

By way of an example, FIG. 1 shows a mortise lock 1 according to the invention that is intended to be mounted on the outer periphery of the leaf 2 for the operation of locking slats 3 that are movably affixed in a fitting groove 4 that extends along the periphery 5 of the leaf 2.

To this end the mortise lock is provided with an operating slat 6 that is coupled or can be coupled at its ends 7 to the aforementioned locking slats 3 and which is moveable along the periphery of the leaf 2 by a turn of an operating handle 8 in order to open and close the window in a known manner.

The mortise lock 1 is intended to be built into the limited space between the fixed frame and the leaf 2 of a window or door and is thus also necessarily limited in thickness A.

Figure 3:
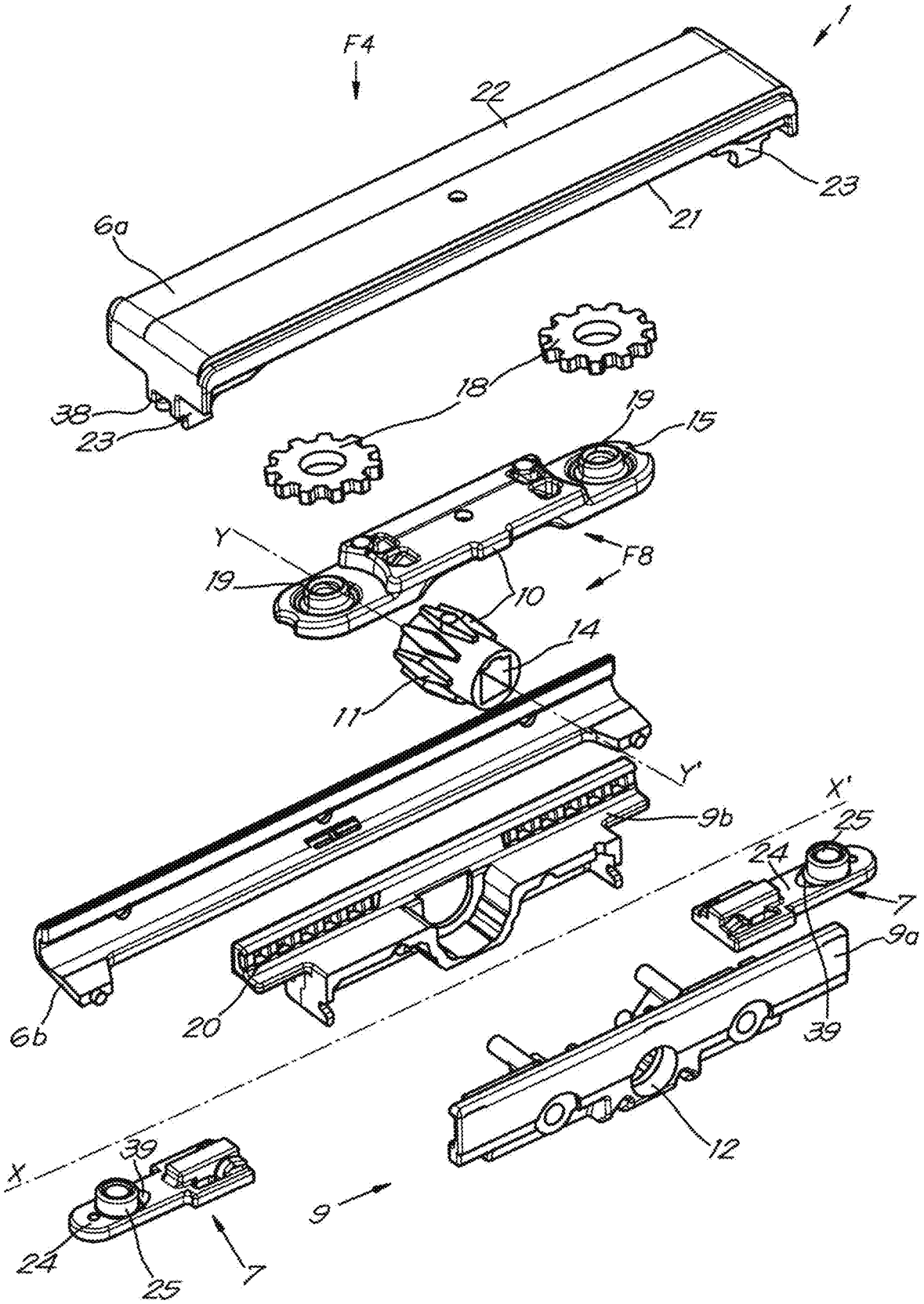
FIG. 3 shows an exploded view of the mortise lock indicated by F3 in FIG. 1.
Figure 4:
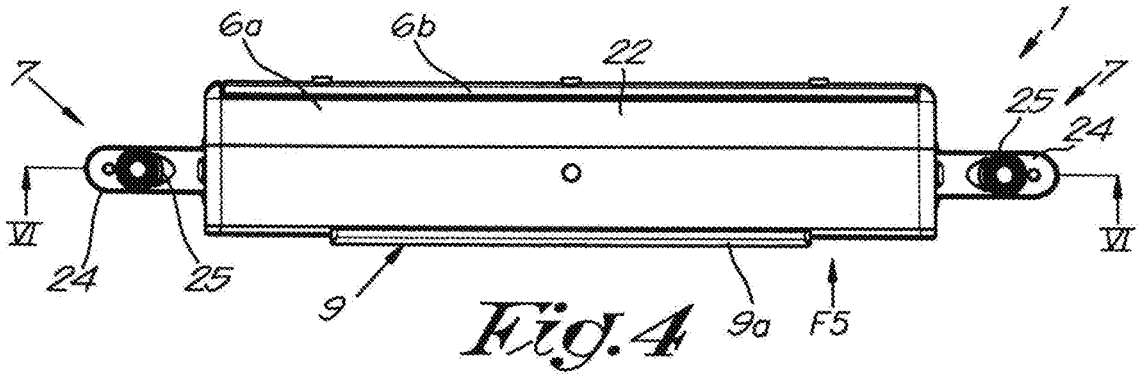
FIGS. 4 and 5 respectively show a view according to arrow F4 in FIG. 3 and according to arrow F5 in FIG. 3, but for a ready-to-use assembled mortise lock.
Figure 5:
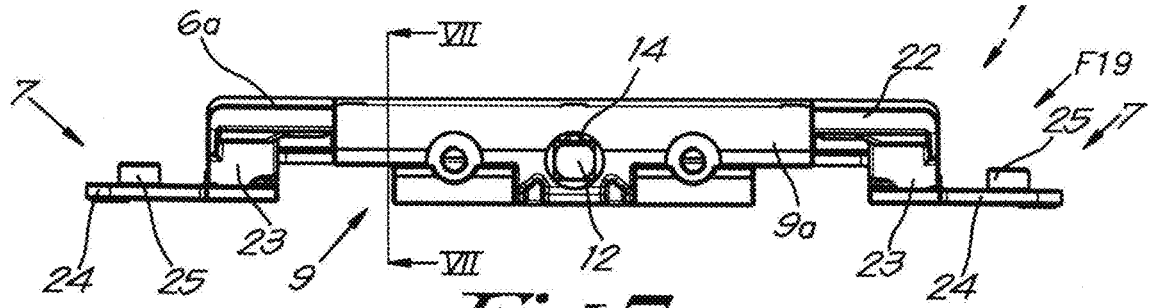
Figure 6:
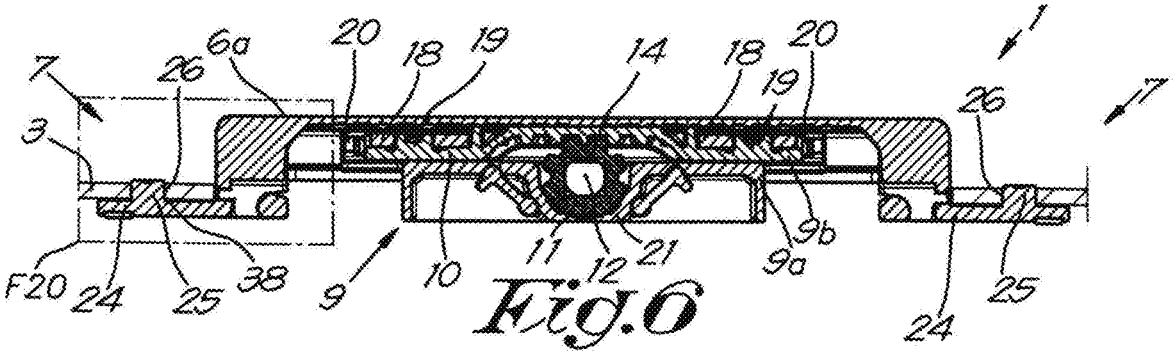
FIG. 6 shows a cross-section according to line VI-VI of FIG. 4.
Figure 7:
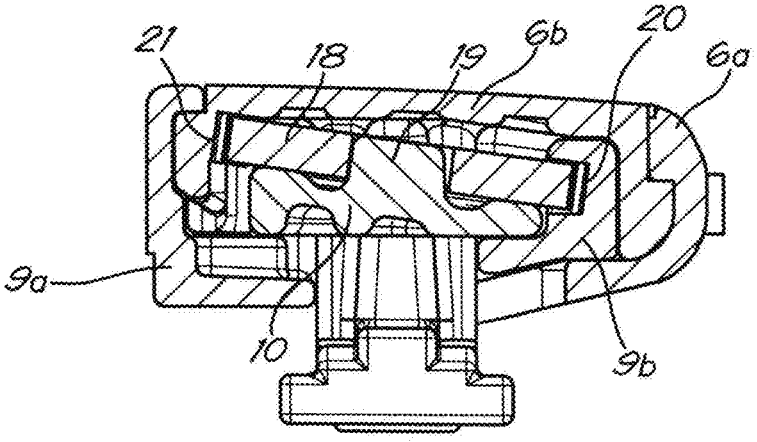
FIG. 7 shows a cross-section according to line VII-VII of FIG. 5.

As is shown in FIG. 3 the mortise lock comprises a housing 9 with a pronounced longitudinal direction X-X' whereby in the embodiment shown this housing 9 is made of two parts with a first part 9*a* and a second part 9*b* that are fastened against one another.

The housing 9 comprises an operating mechanism 10 with a pinion 11 that is mounted on bearings in the housing 9 in a cylindrical passage and which is turnable around a geometric axis Y-Y' by means of an operating handle 8 that is provided with a pin 13 to this end with a square or other non-round cross-section that fits in a corresponding hole 14 that extends axially in the aforementioned pinion and which is inserted through the passage 12 of the housing 9 in the pinion 11.

Furthermore the operating mechanism 10 comprises a rack 15 that is movably affixed in the direction X-X' in the housing 9 and which is movable in the one or the other direction by turning the pinion 11.

To this end the pinion 11 and the rack 15 are each provided with a double toothing 16, 17 respectively.

The rack 15 is provided on the opposite back side of the toothing 17 with two cogwheels 18 that are freely turnably affixed around a shaft 19 on the aforementioned back side of the rack 15.

The teeth of these cogwheels 18 mesh with a toothed rack 20 on an inside of the housing 9 and with their diametrically opposite teeth in a toothed rack 21 on the inside of the aforementioned operating slat 6 that is composed of two parts 6*a* and 6*b* in the example and which is movably affixed on the housing 9 as a type of movable cover.

The part 6*a* of the operating slat 6 is constructed as a central U-shaped part 22 with arms 24 that are provided at their ends with lips 24 that carry a peg 25 by which these lips 24 are coupled to the locking slats 3 that are provided with a corresponding cutaway 26 to this end.

As a result of this composition, by turning the pinion 11 by means of the operating handle 5 in a known way, in the first instance the rack 15 is moved, such that this rack 15 in turn makes the cogwheels 18 turn, which thereby move the operating slat 6 in the aforementioned fitting groove 4 over a double distance with respect to the movement of the operating slat 6 in order to open or close the window.

Figure 8:
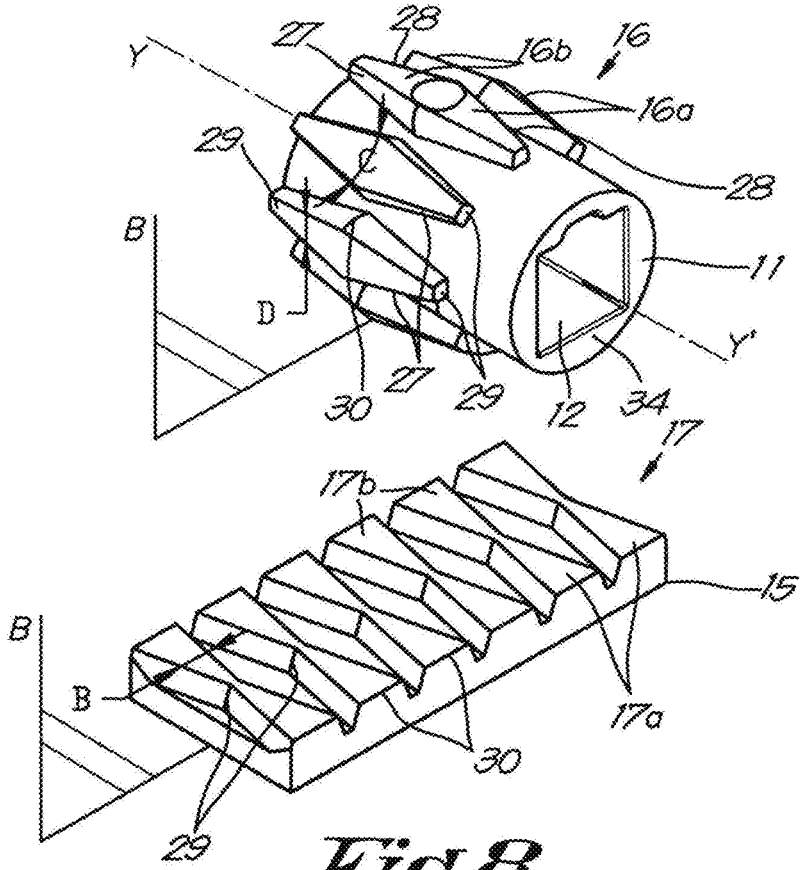
FIG. 8 shows the operating mechanism indicated by F8 in FIG. 3 on a larger scale, but in a reversed position.
Figure 9:
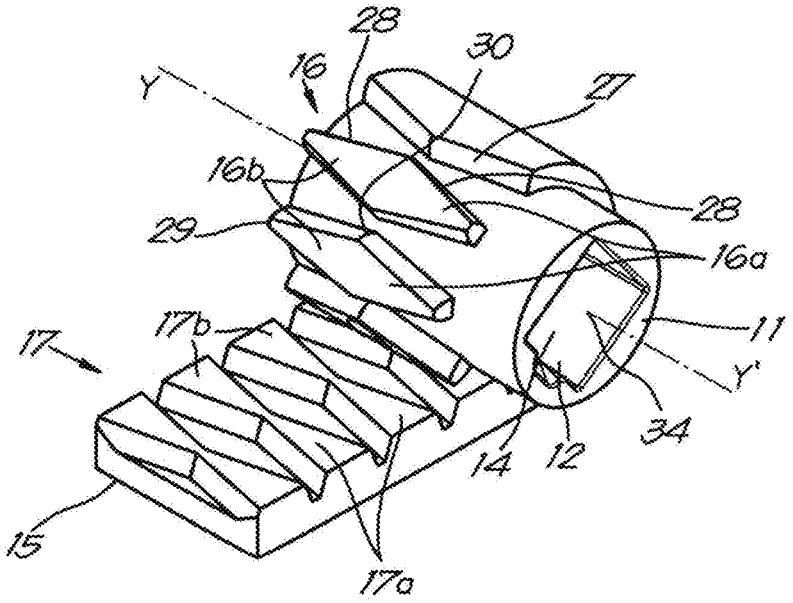
FIG. 9 shows the operating mechanism of FIG. 8, but in an assembled state.

The double toothing 16 of the pinion 11 is, as shown in detail in FIGS. 8 and 9, provided with two contiguous rows of teeth 16*a* and 16*b* that are geometrically separated from one another by a geometric dividing plane B that is oriented perpendicular to the axial direction Y-Y' of the pinion 11.

According to a specific aspect of the invention, the teeth 16*a* and 16*b* of the pinion 11 have the form of teeth of an oblique toothing with faces 27 and 28 that run obliquely with respect to the axial direction Y-Y' and which include an angle C with one another that is such that the width D of the teeth 16*a* and 16*b*, measured in a plane parallel to the dividing plane B, increases in the axial longitudinal direction of the teeth 16*a* and 16*b*, more specifically from the top 29 of the teeth to the broader base 30.

The teeth 16*a* and 16*b*, viewed in their longitudinal direction, have a tapered form with a plane of symmetry through the geometric axis Y-Y' of the pinion 11.

In the case of FIG. 8, the dividing plane B forms a plane of symmetry for the toothings 16*a* and 16 on either side of the dividing plane B, so that these teeth 16*a* and 16*b* extend in each other's axial line and are thus aligned with one another. Their bases 30 connect against one another at the level of the dividing plane B so that the teeth 16*a* and 16*b* together form a rhombic toothing as it were, whereby the faces 27 on one side of the teeth 16 form a first arrow toothing and the faces 28 on the other side of the teeth 16 form a second arrow toothing, whereby both arrow toothings are oriented in opposite directions with respect to one another, at least when viewed according to a direction of rotation around the axis Y-Y'.

In a similar way, the rack 15 is provided with a double toothing 17 with two rows of teeth 17*a* and 17*b* whose form is complementary to the teeth 16*a* and 16*b* of the pinion 11.

The teeth 17*a* and 17*b* also have a tapered form whose width D is in this case smaller in the direction of the dividing plane B that coincides with the dividing plane B of the double toothing 16 of the pinion 11.

In this way, the teeth 17*a* and 17*b* together of the double toothing 17 form a diabolo shape.

It is notable that the teeth of the pinion 11 and the rack are robust teeth despite the small diameter of the pinion 11.

Figure 10:
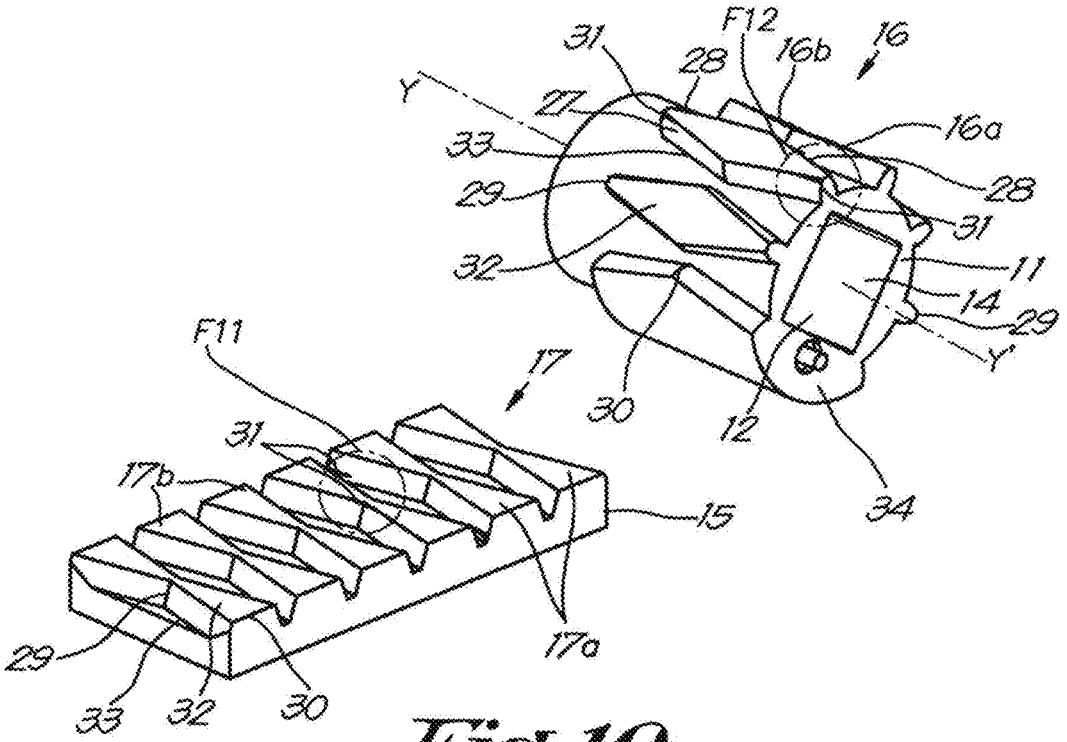
FIG. 10 shows the operating mechanism of FIG. 8 viewed from the back and with the indication of the contact zones between the teeth.

The toothings 16 and 17 of the pinion 11 and the rack 15 mesh with one another as shown in FIG. 10.

When the pinion 11 is driven in rotation by the operating handle 5, then the rack 15 is shifted in the direction X-X'.

FIG. 10 shows the contact zones 31 between the toothing 16 of the pinion 11 and the toothing 17 of the rack 15 at the time of the transition from the end of the contact between two teeth to the contact with a subsequent pair of teeth.

Figure 11:
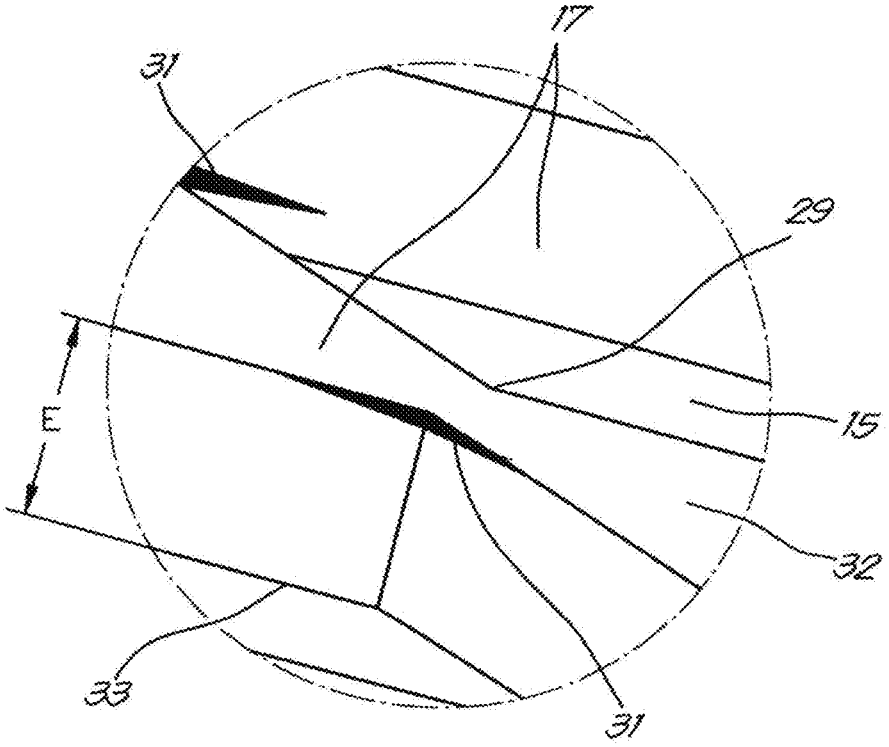
FIGS. 11 and 12 show the circled part indicated by F11 and F12 in FIG. 10 on a larger scale.
Figure 12:
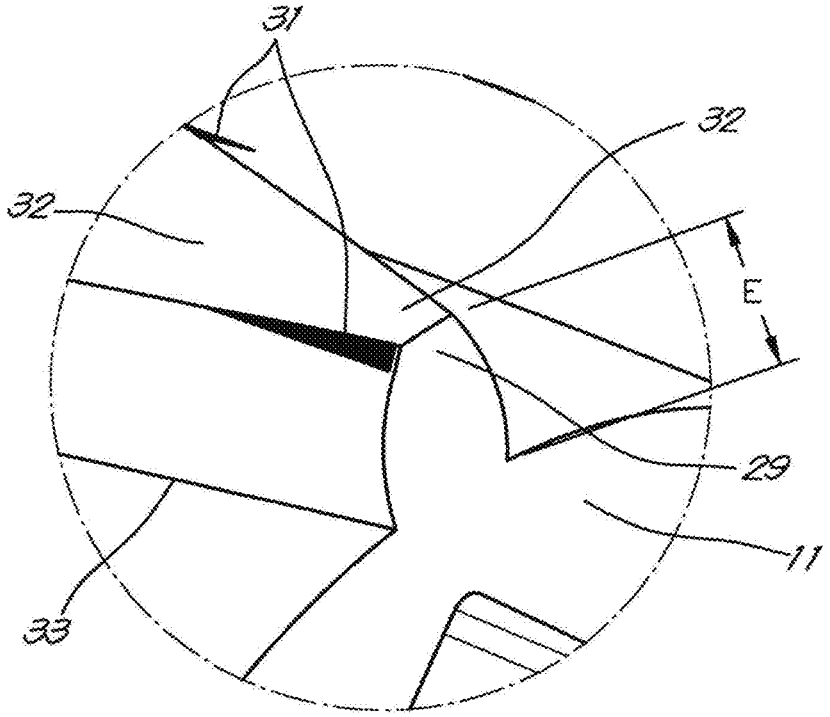

The detail of FIGS. 11 and 12 shows that these contact zones 31 are at the top 32 of the teeth, in other words on the outer periphery of the toothing 16 of the pinion 11 and on the top surface of the rack 15 oriented towards the pinion 11.

It is clear that the pinion 11 can be provided with a diabolo-shaped toothing 16 that can engage with a rhombic toothing 17 of the rack 15, thus the opposite of the operating mechanism 10 described above.

Figure 13:
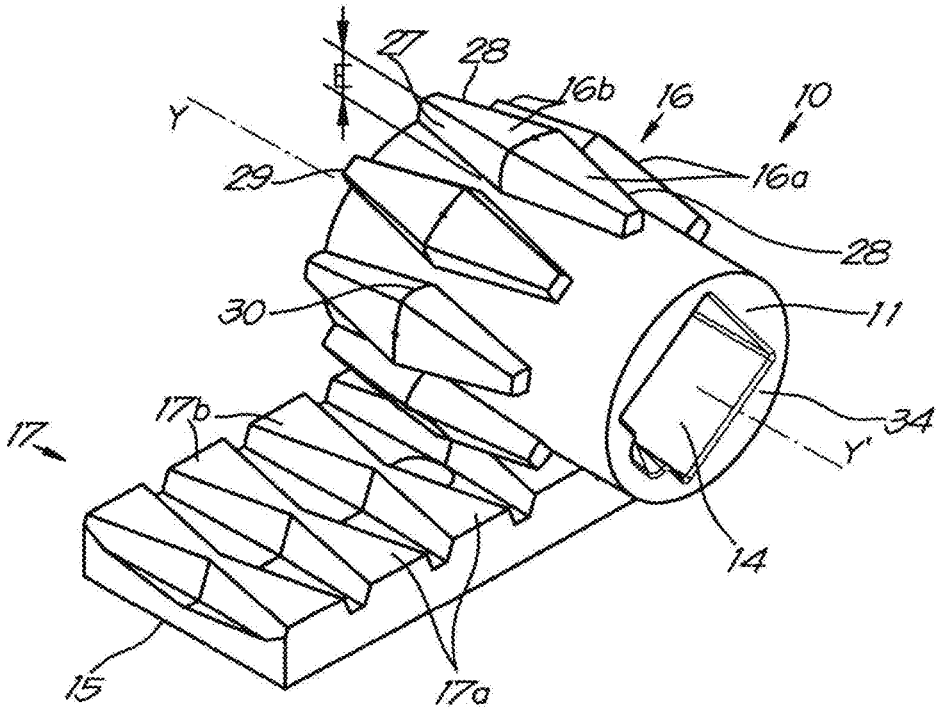
FIGS. 13 and 14 show two different variants of an operating mechanism according to the invention; in the same way as FIG. 10, FIG. 15 indicates the contact zones between the teeth of the operating mechanism of FIG. 14.

A variant of an operating mechanism 10 according to the invention is shown in FIG. 13, whereby in this case the height E of the teeth, measured in the radial direction for the pinion 11 and in a direction perpendicular to the aforementioned top surface of the rack 15, varies in the axial direction Y-Y'.

In the example of FIG. 13, the teeth 16*a* and 16*b* of the pinion 11 are situated with their foot 33 on a cylindrical core 34 and on the top 32 these teeth are placed as a double cone shape, such that the height of the teeth 16*a* and 16*b* increases towards the dividing plane B.

In a similar way, the height of the teeth 17*a* and 17*b* increases from the rack 15 to the dividing plane B.

In this way the range of the smooth transition can be further optimised and the teeth can be made even more robust.

It is not excluded that the height of the teeth is varied by setting the core 34 and/or the tops 32 of the teeth of the pinion as a double cone shape.

Figure 14:
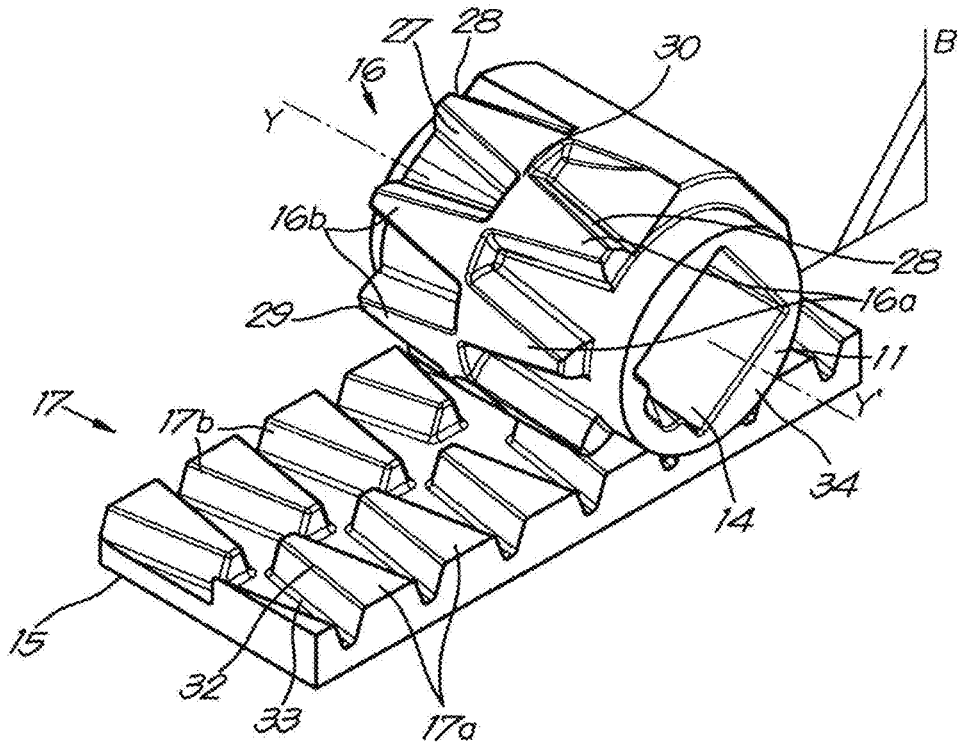

FIG. 14 shows a variant of an operating mechanism 10 according to the invention that departs from the embodiment of FIG. 9 because in this case the teeth 16*a* and 16*b* are offset with respect to one another on either side of the dividing plane B, whereby in other words the toothing 16*a* is turned over a half pitch of the teeth 16 with respect to the toothing 16*b*.

In the same way the teeth of the rack 15 are offset with respect to one another.

Figure 15:
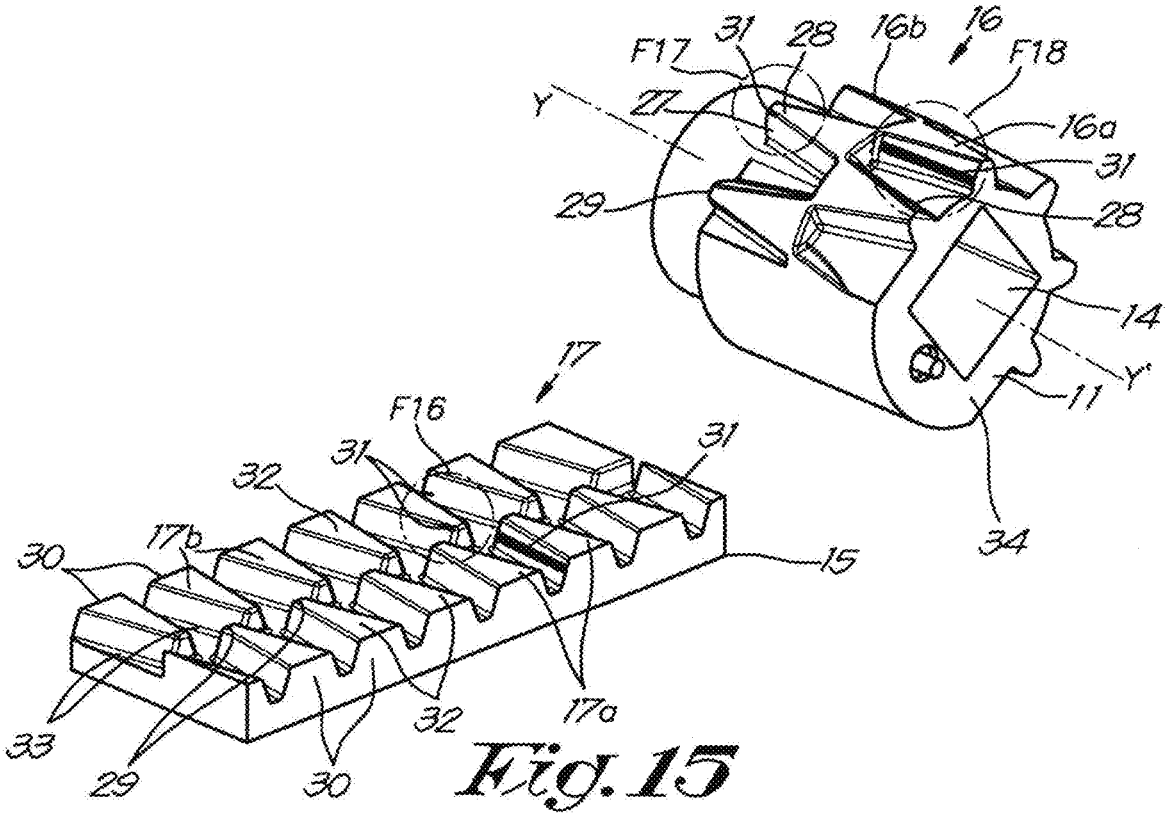
Figure 16:
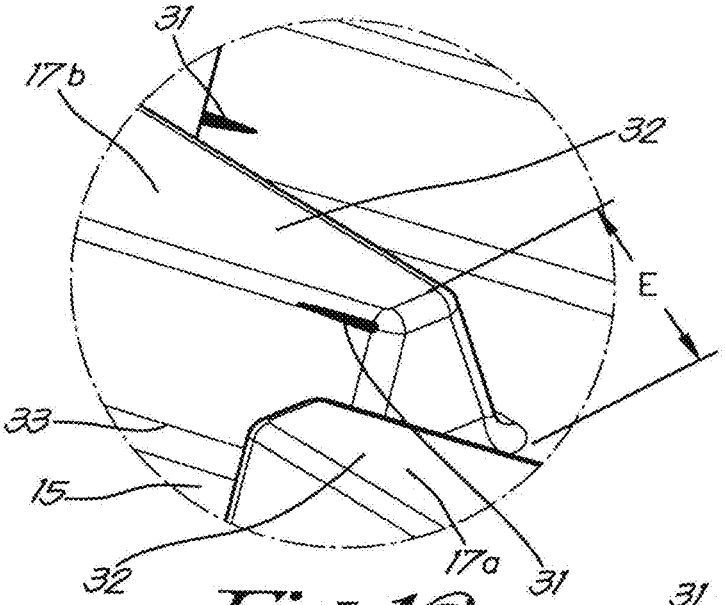
FIGS. 16 to 18 show the circled parts of FIG. 15 on a larger scale, indicated respectively by F16, F17 and F18.
Figure 17:
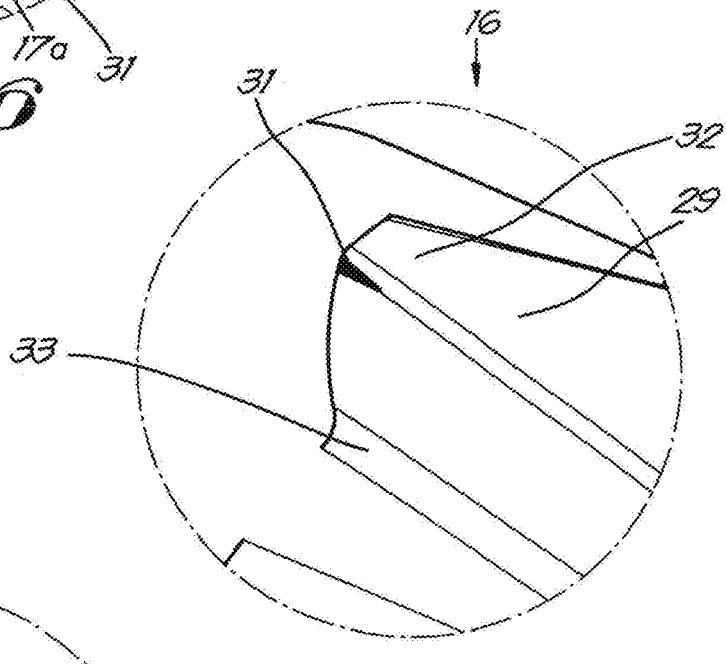
Figure 18:
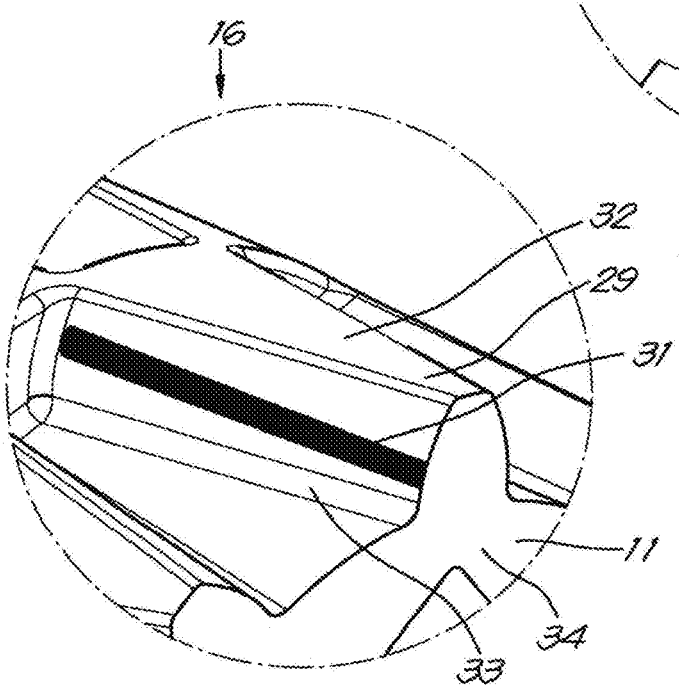

Analogous to FIG. 10, FIG. 15 shows the contact zones in a transition between pinions that are in contact with one another, which shows that the contact zones 31 are better distributed over the length of the faces and are located further from the top of the teeth, such that the risk of turning over is eliminated.

In other words, due to the offset the teeth there is a smoother transition and the number of transitions is doubled resulting in a very smooth operating mechanism 10, additionally with a cancelling out of the axial forces when driven.

The embodiments of pinions 11 illustrated above enable the pinions to be injection moulded making use of a simple mould with two mould halves that are connected together axially at the level of the dividing plane B.

Due to the tapered form of the teeth that become wider towards the dividing plane B, the pinions 11 formed can be easily removed from the mould by axially moving the mould halves apart.

An additional advantage of the offset tooth form of figure is that burrs that inevitably occur during injection moulding on the pinions 11 formed at the dividing plane B are only formed on the outer periphery of the pinions 11, where the burrs can easily be removed, this in contrast to other forms of pinions where burrs are also formed at less easily accessible places between the teeth.

It is clear that such an operating mechanism can also be incorporated in locks of doors as a component of the locking mechanism, for example to operate a latch and/or dead bolt by means of an operating handle or with a door key or similar.

Figure 19:
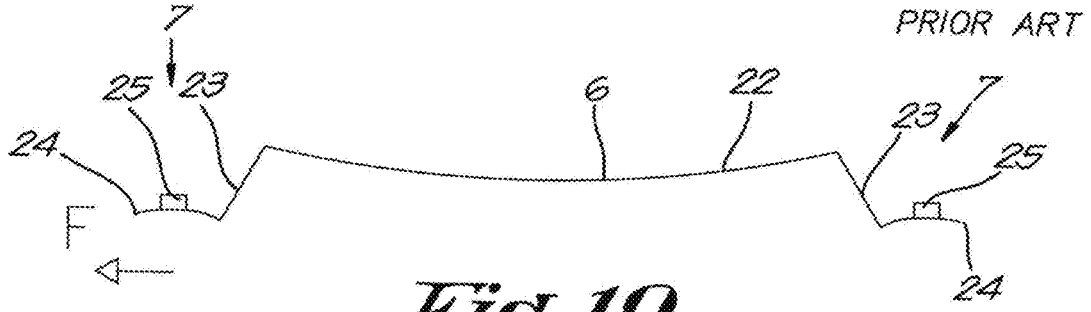
FIG. 19 shows the bending in a stylised form that an operating slat as indicated by F19 in FIG. 5 experiences during use, but for a mortise lock.
Figure 20:
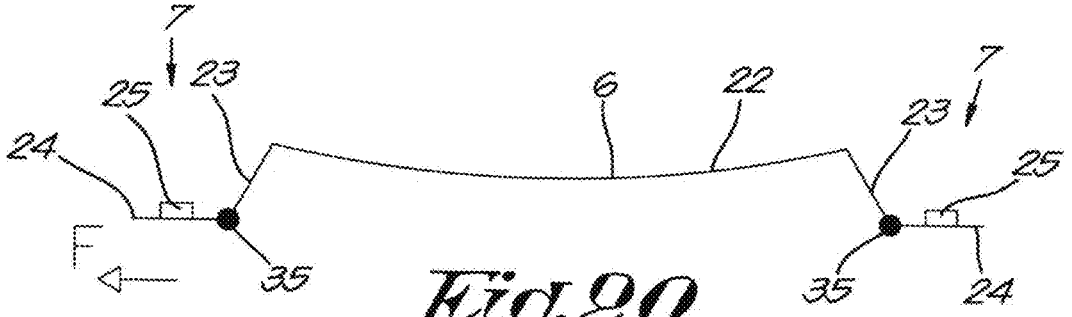
FIG. 20 is an illustration such as that of FIG. 19, but for an operating slat according to the invention.
Figure 21:
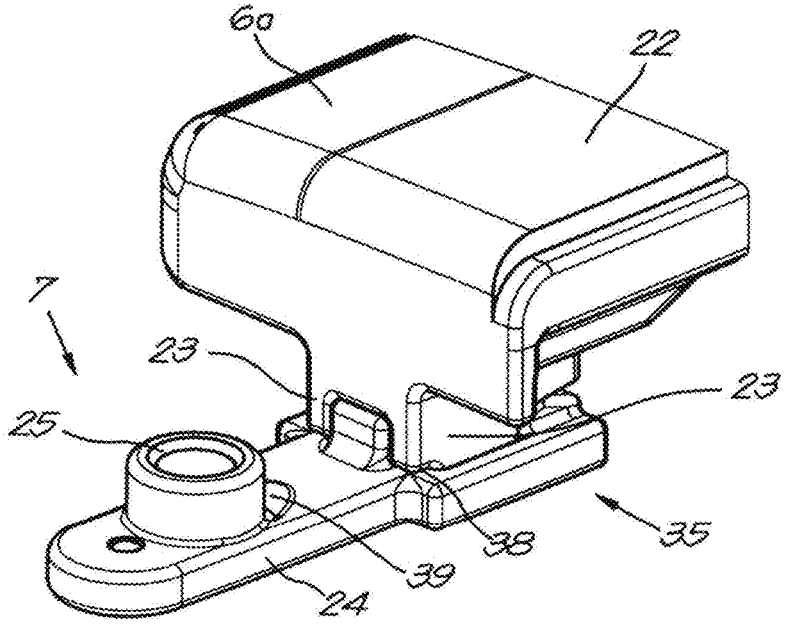
FIG. 21 shows a perspective view of the part indicated by F21 in FIG. 6 on a larger scale.
Figure 22:
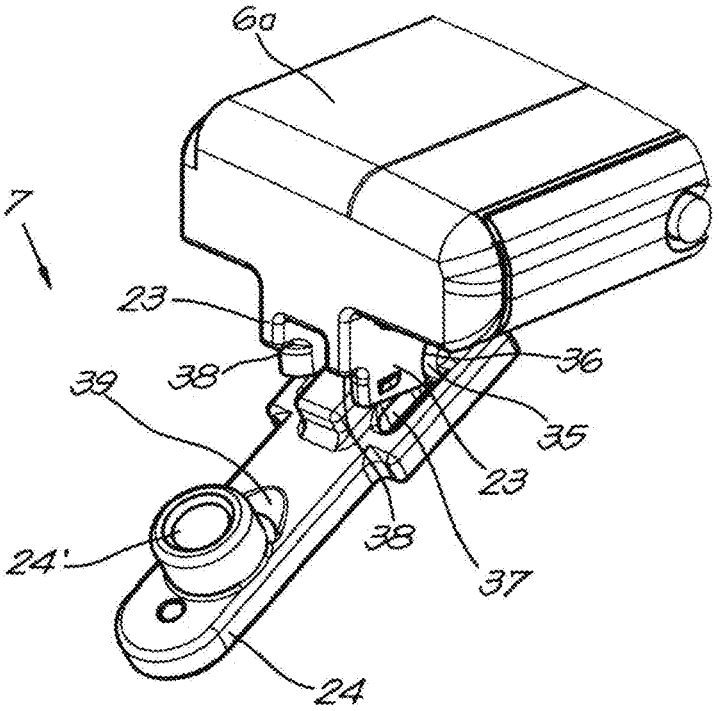
FIGS. 22 and 23 show the part of FIG. 21 but in a different state during mounting.
Figure 23:
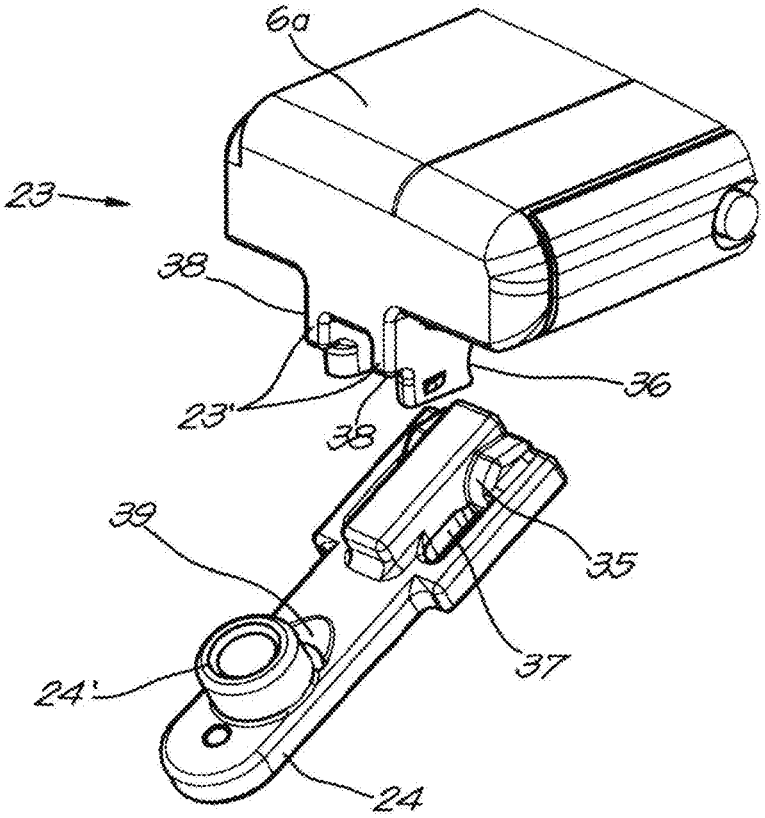

According to another aspect of the invention, the aforementioned lips 24 are hingeably connected by means of a hinge pin 35 to the ends of the arms 23 of the U-shaped part 22 of the operating slat 6, as schematically shown in FIG. 20, this in comparison to a conventional operating slat 6 as schematically shown in FIG. 19 with lips 24 that are rigidly connected to the arms 23.

When operating the mortise lock, opposing tensile and compressive forces are exerted on the lips 24, which in the case of tensile forces pull the arms 23 away from one another and deform the operating slat 6 as illustrated in FIG. 19. At the location of the rigid connection between the lips 24 and the rest of the operating slat 6 bending forces occur that can cause undesired breakages.

With a hingeable embodiment according to the invention with a hinge pin 35 that is oriented transversely to a median plane of the U-shaped part 22, the bending moments are eliminated by the presence of the hinge 35 that thus prevents the occurrence of breakages.

FIGS. 20 to 23 to show a possible embodiment of such a hinged embodiment.

In this case the arms 23 of the U-shaped part 22 are formed by two parallel ears 23' that can act as a bearing for the hinge pin 35 of an aforementioned lip, whereby the bearing of each ear 23' is an open bearing that is formed by a bearing liner 36 that extends over a circular sector so that the lip can easily be mounted and dismantled.

Each lip 24 is provided with two slots 37 that, when the lip 24 turns around the aforementioned hinge pin 35, form a sideways axial guide for ears 23'.

At least one ear 23' is provided with an end stop 38 for the rotation of the lip 23' to a usage position parallel to the back of the U-shaped part 22 of the operating slat 6.

For the coupling to the locking slats 3 the lips 24 are provided with an aforementioned peg 24', whereby in the case of the invention a hollowing 39 is provided locally in the material of the lip 24 over a certain sector around the peg 24' that more or less has the form of the tip of a spoon that extends from the edge of the peg 24' in the direction of the U-shaped part 22.

It is clear that the operating slat can be provided with only one single lip 24.

It is clear that an operating slat 6 according to the invention can also be applied to a mortise lock with a conventional operating mechanism, just as an operating mechanism 10 according to the invention can be applied to a mortise lock 1 with a conventional operating slat.

The present invention is by no means limited to the embodiments described as an example and shown in the drawings, but a mortise lock according to the invention can be realised in all kinds of forms and dimensions without departing from the scope of the invention.

The invention claimed is:

1. A mortise lock comprising:

a housing provided with an operating mechanism that includes a pinion that is mounted in the housing and turntable about a geometric rotation axis, and also includes a rack that engages with the pinion and that is movably affixed in the housing along a first direction perpendicular to said geometric rotation axis, the pinion provided with a double toothing that comprises two sets of teeth that are in a fixed position on the pinion and that extend in opposite directions away from a virtual geometric dividing plane located between the two sets of teeth and extending through and perpendicularly to the geometric rotation axis of the pinion, whereby the teeth of of each set of teeth of the pinion are formed by protrusions extending from a surface of the pinion at a location of the virtual geometric dividing plane, each protrusion having a top-most surface that has a length that extends along a second direction parallel to the geometric rotation axis and extending away from the virtual geometric dividing plane, and a width that decreases as the tooth extends away from the virtual geometric dividing plane along the second direction.

2. The mortise lock according to claim 1, wherein the teeth of the pinion are each symmetric with respect to a respective plane of symmetry extending through the geometric rotation axis of the pinion.

3. The mortise lock according to claim 1, wherein the rack comprises a second two sets of teeth, complementary to the two sets of teeth of the pinion and configured to mesh with the two sets of teeth of the pinion.

4. The mortise lock according to claim 3, wherein the teeth of the two sets of teeth of the pinion and the teeth of the second two sets of teeth of the rack connect along the virtual geometric dividing plane.

5. The mortise lock according to claim 3, wherein the teeth of the two sets of teeth of the pinion, respectively of the second two sets of teeth of the rack, on either side of the virtual geometric dividing plane are aligned with respect to one another in a direction of the geometric rotation axis.

6. The mortise lock according to claim 5, wherein the virtual geometric dividing plane is a plane of symmetry for the teeth of each set of teeth of the pinion on either side of the virtual geometric dividing plane, and for the teeth of the rack on either side of the virtual geometric dividing plane.

7. The mortise lock according to claim 3, wherein the two sets of teeth of the pinion, are offset with respect to one another on either side of the dividing plane.

8. The mortise lock according to claim 1, wherein each tooth of the teeth of the pinion has a height, extending along a respective radial direction from a foot of the tooth at the surface of the pinion to the top-most surface of the tooth, that decreases as the top-most surface of the tooth extends away from the virtual geometric dividing plane along the second direction, and each tooth of the teeth of the rack has a height, defined with respect to a top surface of the rack in a direction perpendicular to said top surface that increases as the tooth extends away from the virtual geometric dividing plane along the second direction plane.

9. The mortise lock according to claim 1, wherein each tooth of the teeth of the pinion has a foot that is affixed upon a cylindrical core of the pinion, and an outside diameter formed by tops of the teeth of the pinion decreases as the teeth extend away from the virtual geometric dividing plane.

10. The mortise lock according to claim 9, wherein the rack comprises a second two sets of teeth configured to mesh with the two sets of teeth of the pinion, the virtual geometric dividing plane extending between said second two sets of teeth, each tooth of the second two sets of teeth having a height that increases as the tooth extends away from the virtual geometric dividing plane.

11. The mortise lock according to claim 1, wherein the outermost diameter of the pinion is smaller than 15 millimetres.

12. A mortise lock for a window having a fixed frame with a turnable leaf therein, the mortise lock comprising:

a housing; and a movably affixed operating slat on the housing that is configured for operating at least one locking slat of the window that is movably affixed along the periphery of the turnable leaf, the operating slat including a central U-shaped part with two arms that, on free ends thereof, each have a sideways protruding lip configured to couple to the locking slat of the window, wherein at least one protruding lip is freely hingeably connected by means of a hinge pin to the U-shaped part, whereby the hinge pin is oriented transversely on a median plane of the U-shaped part.

13. The mortise lock according to claim 12, wherein at least one arm of the U-shaped part is formed by two parallel ears operable as a bearing for the hinge pin of the at least one protruding lip.

14. The mortise lock according to claim 13, wherein each of the two parallel ears is an open bearing that is formed by a bearing liner that extends over a circular sector.

15. The mortise lock according to claim 13, wherein the at least one protruding lip is provided with at least one slot that forms a sideways guide, when turning the at least one protruding lip in the ears, for one of the two parallel ears.

16. The mortise lock according to claim 13, wherein at least one of the two parallel ears is provided with an end stop for turning the at least one protruding lip to a usage position parallel to a back of the U-shaped part of the operating slat.

17. The mortise lock according to claim 12, wherein the lip is provided with a peg configured to couple the lip to the locking slat of the window, and a hollowing is provided locally in the material of the at least one protruding lip over a sector around the peg.

18. The mortise lock according to claim 17, wherein the hollowing is formed as a spoon tip and the hollowing extends from an edge of the peg in a direction of the hinge pin.

19. The mortise lock according to claim 1, wherein the mortise lock is configured for a window with a fixed frame and a turnable leaf therein, whereby the mortise lock is provided a movably affixed operating slat for operating at least one locking slat of the window that is movably affixed along the periphery of the turnable leaf, the operating slat including a central U-shaped part with two arms that, on free ends thereof, each have a sideways protruding lip configured to couple to the at least one locking slat, wherein at least one protruding lip is freely hingeably connected by means of a hinge pin to the U-shaped part, whereby the hinge pin is oriented transversely on a median plane of the U-shaped part.

20. The mortise lock according to claim 11, wherein the outermost diameter of the pinion is smaller than 10 millimetres.

* * * * *